US009261012B2

(12) United States Patent
Saitoh

(10) Patent No.: US 9,261,012 B2
(45) Date of Patent: Feb. 16, 2016

(54) ABNORMALITY DETERMINATION APPARATUS AND ABNORMALITY DETERMINATION METHOD FOR COOLANT TEMPERATURE SENSOR, AND ENGINE COOLING SYSTEM

(75) Inventor: Tatsuki Saitoh, Susono (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 281 days.

(21) Appl. No.: 13/879,185

(22) PCT Filed: Nov. 8, 2011

(86) PCT No.: PCT/IB2011/002625

§ 371 (c)(1),
(2), (4) Date: Apr. 12, 2013

(87) PCT Pub. No.: WO2012/063113

PCT Pub. Date: May 18, 2012

(65) Prior Publication Data

US 2013/0213324 A1 Aug. 22, 2013

(30) Foreign Application Priority Data

Nov. 11, 2010 (JP) ..... 2010-253207

(51) Int. Cl.
*F01P 7/14* (2006.01)
*F01P 7/16* (2006.01)
(Continued)

(52) U.S. Cl.
CPC . *F01P 7/16* (2013.01); *F01P 7/165* (2013.01); *F01P 11/16* (2013.01); *F01P 2005/105* (2013.01); *F01P 2007/146* (2013.01); *F01P 2060/08* (2013.01); *F01P 2070/04* (2013.01)

(58) Field of Classification Search
CPC ..... F01P 7/165; F01P 7/16; F01P 2007/146; F01P 2005/105; F01M 25/0728
USPC ..... 123/41.09, 41.08, 41.1, 41.4, 41.3
See application file for complete search history.

(56) References Cited

U.S. PATENT DOCUMENTS 4,319,547 A * 3/1982 Bierling ..... F01P 7/165 123/41.08
5,003,954 A * 4/1991 Yakuwa ..... F02D 41/067 123/198 D (Continued)

FOREIGN PATENT DOCUMENTS

JP A-2007-192045 8/2007
JP A-2008-208716 9/2008

(Continued)

*Primary Examiner* — Marguerite McMahon
*Assistant Examiner* — James Kim
(74) *Attorney, Agent, or Firm* — Oliff PLC

(57) ABSTRACT

When a temperature difference between intake air temperature that detected by an intake air temperature sensor and engine coolant temperature thw1 detected by an engine coolant temperature sensor is greater than a threshold value, a coolant temperature sensor abnormality determination apparatus opens a changeover valve to cause the coolant to flow into an engine coolant passageway, thereby mixing the coolant in an engine and the coolant in a heater passageway (bypass passageway). If the temperature difference between the engine coolant temperature thw1 and a heater inlet coolant temperature (bypass coolant temperature) thw2 occurring after the changeover valve opens is less than or equal to a predetermined value, the apparatus determines that the engine coolant temperature sensor is normal. If the temperature difference is greater than the predetermined value, the apparatus determines that the engine coolant temperature sensor is abnormal.

13 Claims, 8 Drawing Sheets

(51) Int. Cl.
*F01P 11/16* (2006.01)
*F01P 5/10* (2006.01)

(56) References Cited

U.S. PATENT DOCUMENTS 5,076,248 A * 12/1991 Schatz ..... F01P 3/20 123/556
5,299,550 A * 4/1994 Inoue ..... F02D 41/22 123/674
5,669,363 A * 9/1997 Francis ..... 123/563
6,178,929 B1 * 1/2001 Schatz ..... 123/41.14
6,539,899 B1 * 4/2003 Piccirilli ..... F01P 7/167 123/41.08
7,267,086 B2 * 9/2007 Allen et al. ..... 123/41.44
8,170,779 B2 * 5/2012 Iwase et al. ..... 701/114
2005/0126517 A1 * 6/2005 Piccirilli ..... F01P 7/16 123/41.09
2008/0300774 A1 12/2008 Wakahara

FOREIGN PATENT DOCUMENTS

JP A-2008-230422 10/2008
JP A-2008-232031 10/2008
JP A-2008-298059 12/2008
JP A-2009-150266 7/2009

* cited by examiner

ABNORMALITY DETERMINATION APPARATUS AND ABNORMALITY DETERMINATION METHOD FOR COOLANT TEMPERATURE SENSOR, AND ENGINE COOLING SYSTEM

BACKGROUND OF THE INVENTION

1. Field of the Invention

The invention relates to a cooling system of an engine (internal combustion engine) and, more particularly, to a coolant temperature sensor abnormality determination apparatus and a coolant temperature sensor abnormality determination method that determine the presence or absence of abnormality of a coolant temperature sensor that detects the temperature of a coolant of the engine.

2. Description of Related Art

With regard to an engine mounted in a vehicle or the like, a coolant jacket as a coolant passageway is provided in the engine (a cylinder block or a cylinder head), and the entire engine is cooled (or warmed) by circulating a coolant via the coolant jacket by a coolant pump. In conjunction with such a cooling system, there exists a technology in which a coolant outlet of the engine is provided with a changeover valve, and while the engine is cold, the changeover valve is closed to stop passage of the coolant within the engine (within the coolant jacket) (to perform an in-engine coolant stop) so that quick warm-up of the engine is accomplished (e.g., see Japanese Patent Application Publication No. 2009-150266 (JP-A-2009-150266)).

Besides, the cooling system of the engine is provided with a coolant temperature sensor that detects the temperature of the coolant. As a technology of detecting abnormality of the coolant temperature sensor, there exists a coolant temperature sensor abnormality detection method described in Japanese Patent Application Publication No. 2007-192045 (JP-A-2007-192045). In the method described in the publication JP-A-2007-192045, if a temperature difference between the temperature detected by the coolant temperature sensor that detects the coolant temperature of the engine and the temperature detected by an intake air temperature sensor that detects the temperature of intake air of the engine is outside a predetermined range, it is determined that there is "abnormality of the coolant temperature sensor" or "a block heater attached or the high-temperature soaking", and, after that, if the coolant temperature value detected by the coolant temperature sensor declines when the coolant pump is driven, it is determined that abnormality of the coolant temperature sensor is not present but an attached block heater or the high-temperature soaking is present.

By the way, in the cooling system that performs the aforementioned in-engine coolant stop, if the foregoing abnormality detection method is applied to the determination regarding abnormality of the coolant temperature sensor, it sometimes happens that although the coolant temperature sensor is normal, the coolant temperature sensor is determined as being abnormal (false abnormality determination). That is, in the foregoing cooling system, when the engine has just been started (while the engine is cold), passage of the coolant within the engine is stopped by closing the changeover valve provided at the coolant outlet of the engine. During this state, even if the coolant pump is driven, the coolant does not flow into the engine (into the coolant jacket) from outside (the actual coolant temperature does not change); therefore, since the coolant temperature detected by the coolant temperature sensor does not decline, it is sometimes falsely determined that the coolant temperature sensor is abnormal although the coolant temperature sensor is normal.

SUMMARY OF THE INVENTION

The invention provides a coolant temperature sensor abnormality determination apparatus and a coolant temperature sensor abnormality determination method that are capable of precisely determining whether a coolant temperature sensor is abnormal without making a false determination, in a cooling system that stops passage of a coolant within an engine.

A coolant temperature sensor abnormality determination apparatus in accordance with a first aspect of the invention is a coolant temperature sensor abnormality determination apparatus which is applied to a cooling system (a cooling system that performs an in-engine coolant stop) that includes an engine coolant passageway, a bypass passageway (heater passageway) that bypasses an engine, a control valve (changeover valve) that restricts circulation of a coolant between the engine coolant passageway and the bypass passageway, an engine coolant temperature sensor that detects engine coolant temperature in the engine coolant passageway, and a bypass coolant temperature sensor (heater inlet coolant temperature sensor) that detects bypass coolant temperature in the bypass passageway, and which determines whether the engine coolant temperature sensor is abnormal, the coolant temperature sensor abnormality determination apparatus being characterized by comprising determination means for opening the control valve when a difference between atmospheric temperature around the engine (concretely, for example, an intake air temperature detected by an intake air temperature sensor that detects the temperature of air taken into the engine) and the engine coolant temperature detected by the engine coolant temperature sensor is greater than a threshold value, and for determining that the engine coolant temperature sensor is normal, if the difference between the engine coolant temperature and the bypass coolant temperature occurring after the control valve opens is less than or equal to a predetermined value, and for determining that the engine coolant temperature sensor is abnormal, if the difference between the engine coolant temperature and the bypass coolant temperature occurring after the control valve opens is greater than the predetermined value.

The coolant temperature sensor abnormality determination apparatus in accordance with the foregoing aspect of the invention, at the time of start of the engine, determines that the coolant temperature sensor is normal if the difference between the engine coolant temperature detected by the coolant temperature sensor and the atmospheric temperature around the engine (the intake air temperature detected by the intake air temperature sensor) is less than or equal to the threshold value (e.g., |engine coolant temperature-intake air temperature|≤20° C.). On the other hand, if the difference between the engine coolant temperature and the atmospheric temperature around the engine is greater than the threshold value (e.g., |engine coolant temperature-intake air temperature|≥20° C.), it can be considered that a block heater has been attached or that the engine coolant temperature sensor is abnormal, and therefore the apparatus opens the control valve that restricts the circulation of the coolant between the engine coolant passageway and the bypass passageway.

Because the control valve is opened, the coolants in the two passageways, that is, the engine coolant passageway and the bypass passageway, circulate so that the coolants from the two passageways mix together. Due to such mixture of the coolants, the coolant temperature of the coolant that flows in the engine coolant passageway and the coolant temperature of the coolant that flows in the bypass passageway become close to each other (or equal to each other) even in the case where the block heater has been attached. Therefore, provided that the engine coolant temperature sensor is normal, the engine coolant temperature detected by the coolant temperature sensor and the bypass coolant temperature detected by the bypass coolant temperature sensor become close to each other. Utilizing these points, the coolant temperature sensor abnormality determination apparatus in accordance with the foregoing aspect determines that the engine coolant temperature sensor is normal, in the case where the temperature difference between the engine coolant temperature (detected value) and the bypass coolant temperature (detected value) after the control valve is opened is less than or equal to a predetermined value (e.g., |engine coolant temperature-bypass coolant temperature|≤20° C.), and the apparatus determines that the engine coolant temperature sensor is abnormal, in the case where the temperature difference between the engine coolant temperature and the bypass coolant temperature is greater than the predetermined value (e.g., |engine coolant temperature-bypass coolant temperature|≥20° C.).

As described above, according to the coolant temperature sensor abnormality determination apparatus in accordance with the foregoing aspect of the invention, when the temperature difference between the atmospheric temperature around the engine (the intake air temperature detected by the intake air temperature sensor) and the engine coolant temperature detected by the engine coolant temperature sensor is greater than the threshold value, the apparatus opens the control valve to mix the coolant in the engine coolant passageway and the coolant in the bypass passageway (causes the coolant to flow into the engine) so that the coolant temperature environments of the engine coolant temperature sensor and of the bypass coolant temperature sensor become equal, and after such a state has been obtained, the determination regarding the engine coolant temperature sensor is performed on the basis of the temperature difference between the engine coolant temperature and the bypass coolant temperature detected by the two coolant temperature sensors. Therefore, the presence of abnormality of the engine coolant temperature sensor can be precisely determined without making a false determination.

Besides, in the coolant temperature sensor abnormality determination apparatus in accordance with the foregoing aspect, the control valve that restricts the circulation of the coolant between the engine coolant passageway and the bypass passageway may be a temperature-sensitive operation valve that has a temperature sensitive portion that displaces a valve body, and the coolant temperature sensor abnormality determination apparatus may determine that the control valve has opened, when an estimated value of ambient coolant temperature of the control valve becomes equal to or greater than a valve-opening temperature of the control valve. Adoption of this construction makes it possible to shorten the time that is needed for determination whether the control valve has opened. This will be explained below.

Firstly, a cooling system (a cooling system that performs an in-engine coolant stop) uses, for example, a temperature-sensitive operation valve that has a temperature sensitive portion that displaces a valve body, as a control valve provided at a coolant outlet of the engine. In this case, an electric heater is buried in the temperature sensitive portion so that the control valve can also be forced to open by melting the thermo-wax through the use of heat produced by electrifying the electric heater (i.e. to open by electrification of the heater). The valve is opened by electrifying the heater when the temperature difference between the engine coolant temperature and the atmospheric temperature around the engine (the intake air temperature detected by the intake air temperature sensor) is greater than the threshold value. An example of the method of determining whether the control valve has opened is a method of determining whether the valve has opened by using the elapsed time following the start of electrification of the electric heater.

In the case where it is determined that the control valve has opened on the basis of the duration of electrification of the heater, in order to prevent a false determination that the control valve has opened when the valve actually has not opened, an open-valve state criterion value is adapted on the basis of the condition in which it takes the longest time before the control valve is opened. However, as for such an adaptation, the margin is very large, so that there is inevitably a long time before the determination regarding the normality or abnormality of the engine coolant temperature sensor is performed. However, by adopting a method in which it is determined that the control valve has opened when the estimated value of the ambient coolant temperature of the control valve becomes equal to or greater than the valve-opening temperature, it becomes possible to determine that the control valve has opened according to the actual open state of the valve. Since this eliminates the need to provide the aforementioned margin, only a short time is needed before it is determined that the valve has opened, so that the time prior to the determination regarding the normality or abnormality of the engine coolant temperature sensor can be shortened.

It is to be noted herein that in the coolant temperature sensor abnormality determination apparatus in accordance with the foregoing aspect, if the determination regarding the engine coolant temperature sensor is performed during a state in which the coolant in the engine coolant passageway and the coolant in the bypass passageway are not sufficiently mixed together after the control valve has opened, there is a possibility of making a false determination that the sensor is abnormal when the sensor is actually normal. Hence, in the coolant temperature sensor abnormality determination apparatus in accordance with the foregoing aspect, in order to prevent the false abnormality determination, the determination regarding the engine coolant temperature sensor may be executed after elapse of a predetermined time following the opening of the control valve (i.e., after elapse of a time that is needed for the coolants in the foregoing two passageways to sufficiently mix together).

According to the coolant temperature sensor abnormality determination apparatus in accordance with the foregoing aspect, when the temperature difference between the atmospheric temperature around the engine and the engine coolant temperature detected by the engine coolant temperature sensor is greater than the threshold value, the apparatus opens the control valve to mix the coolant in the engine coolant passageway and the coolant in the bypass passageway, and then the determination regarding the coolant temperature sensor is performed on the basis of the temperature difference between the engine coolant temperature and the bypass coolant temperature occurring after the control valve has opened. Therefore, the presence of abnormality of the engine coolant temperature sensor can be precisely determined without making a false determination.

A coolant temperature sensor abnormality determination method in accordance with a second aspect of the invention is a coolant temperature sensor abnormality determination method which is for use in an engine cooling system that includes an engine coolant passageway, a bypass passageway that bypasses an engine, a control valve that restricts circulation of a coolant between the engine coolant passageway and the bypass passageway, an engine coolant temperature sensor that detects engine coolant temperature in the engine coolant passageway, and a bypass coolant temperature sensor that detects bypass coolant temperature in the bypass passageway, and which determines whether the engine coolant temperature sensor is abnormal, and the method includes: opening the control valve when a difference between atmospheric temperature around the engine and the engine coolant temperature detected by the engine coolant temperature sensor is greater than a threshold value; determining that the engine coolant temperature sensor is normal, if the difference between the engine coolant temperature and the bypass coolant temperature occurring after the control valve opens is less than or equal to a predetermined value; and determining that the engine coolant temperature sensor is abnormal, if the difference between the engine coolant temperature and the bypass coolant temperature occurring after the control valve opens is greater than the predetermined value.

An engine cooling system in accordance with a third aspect of the invention includes: an engine coolant passageway; a bypass passageway that bypasses an engine; a control valve that restricts circulation of a coolant between the engine coolant passageway and the bypass passageway; an engine coolant temperature sensor that detects engine coolant temperature in the engine coolant passageway; a bypass coolant temperature sensor that detects bypass coolant temperature in the bypass passageway; and a coolant temperature sensor abnormality determination portion which opens the control valve when a difference between atmospheric temperature around the engine and the engine coolant temperature detected by the engine coolant temperature sensor is greater than a threshold value, and which determines that the engine coolant temperature sensor is normal, if the difference between the engine coolant temperature and the bypass coolant temperature occurring after the control valve opens is less than or equal to a predetermined value, and which determines that the engine coolant temperature sensor is abnormal, if the difference between the engine coolant temperature and the bypass coolant temperature occurring after the control valve opens is greater than the predetermined value.

According to the coolant temperature sensor abnormality determination method in accordance with the second aspect and the engine cooling system in accordance with the third aspect, it is possible to achieve substantially the same effects as those achieved by the coolant temperature sensor abnormality determination apparatus in accordance with the first aspect.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
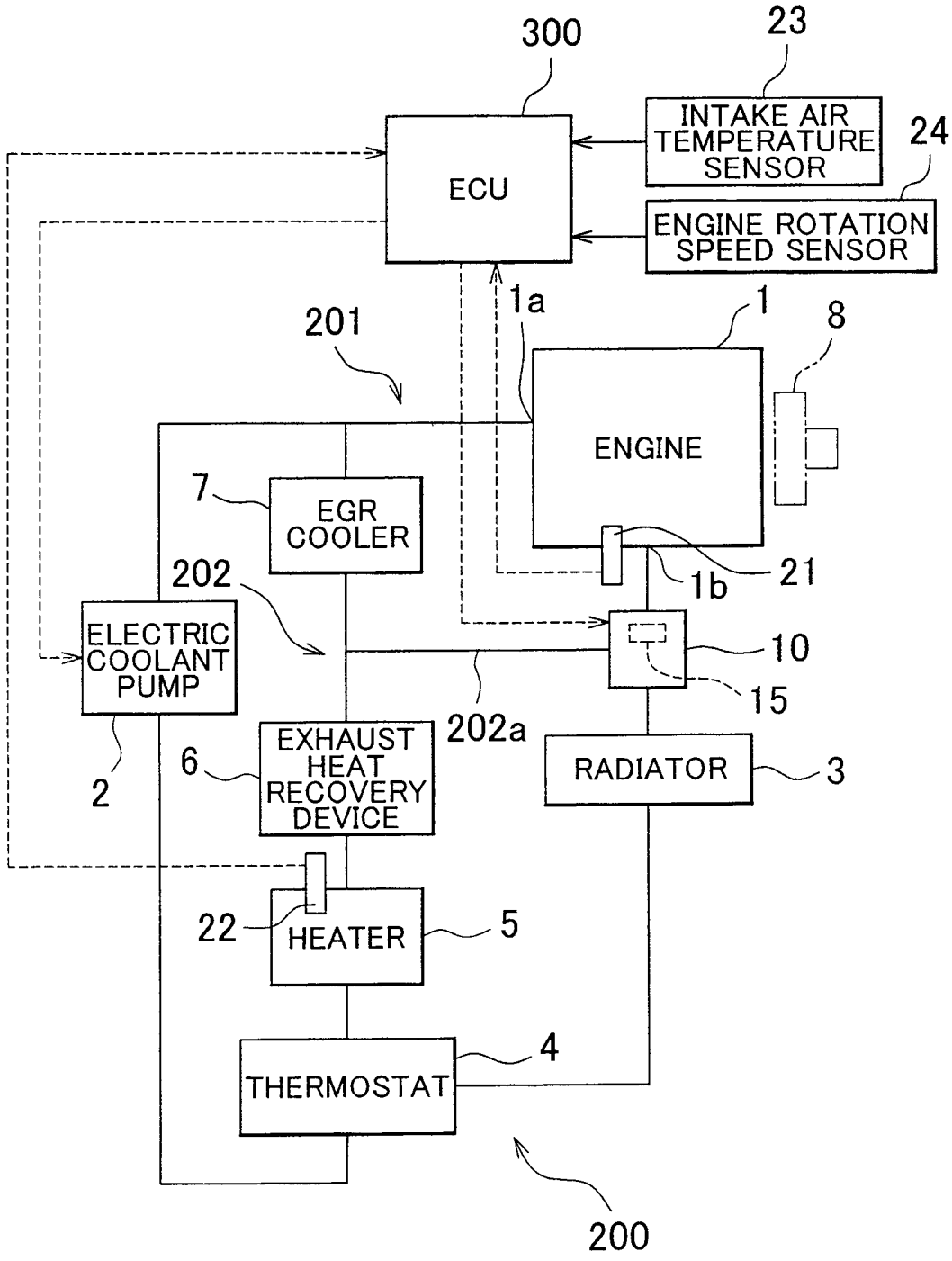
FIG. 1 is a general construction diagram showing an example of a cooling system of an engine to which an embodiment of the invention is applied.

Hereinafter, embodiments of the invention will be described with reference to the drawings.

A cooling system of an engine 1 (an in-engine coolant stop cooling system) will be described with reference to FIG. 1.

The cooling system of this embodiment includes an electric coolant pump 2, a radiator 3, a thermostat 4, a heater 5, an exhaust heat recovery device 6, an EGR (Exhaust Gas Recirculation) cooler 7, a changeover valve 10, a coolant passageway 200 for circulating a coolant to these appliances, etc.

The coolant passageway 200 includes an engine coolant passageway 201 that circulates the coolant (e.g., LLC (Long Life Coolant)) via the engine 1, the radiator 3 and the thermostat 4, and a heater passageway 202 that circulates the coolant via the EGR cooler 7, the exhaust heat recovery device 6, the heater 5 and the thermostat 4. In this embodiment, for both the circulation of the coolant through the engine coolant passageway 201 and the circulation of the coolant through the heater passageway 202, one electric coolant pump (electric water pump) 2 is employed.

The engine 1 is a gasoline engine, a diesel engine, etc., that is mounted in a conventional vehicle, a hybrid vehicle, etc., and a cylinder block and a cylinder head of the engine are provided with a coolant jacket (not shown). The engine 1 is provided with an engine coolant temperature sensor 21 that detects the coolant temperature at a coolant outlet (a coolant jacket outlet of the cylinder head) 1*b*. Besides, in an intake passageway of the engine 1, there is disposed an intake air temperature sensor 23 that detects the temperature of intake air. Furthermore, for the engine 1, there is disposed an engine rotation speed sensor 24 that detects the rotation speed of a crankshaft, that is, an output shaft (the engine rotation speed). Output signals of the engine coolant temperature sensor 21, the intake air temperature sensor 23 and the engine rotation speed sensor 24 are input to an ECU (Electronic Control Unit) 300.

Besides, the engine 1 of this embodiment is designed so that a block heater 8 can be freely detachably attached. By electrifying the block heater 8 (supplying it with electric power from a commercial electric power source) when the block heater 8 is attached to the engine 1, it is possible to warm the coolant within the engine 1 (within the coolant jacket) during a stop of the engine. By warming the coolant within the engine 1 during a stop of the engine in this manner, the state of combustion at the time of starting the engine 1 becomes good, so that the engine startability improves.

The electric coolant pump 2 is a coolant pump whose discharge flow amount (discharge pressure) can be variably set by controlling the rotation speed of an electric motor. The electric coolant pump 2 is disposed so that a discharge port thereof communicates with a coolant inlet 1*a* of the engine 1 (an inlet of the coolant jacket). The operation of the electric coolant pump 2 is controlled by the ECU 300. Besides, the electric coolant pump 2 is driven along with the starting of the engine 1, and the discharge flow amount thereof is controlled according to the operation state of the engine 1, and the like.

The thermostat 4 is a valve device that operates by, for example, expansion and contraction of a thermo-wax of a temperature sensitive portion, and is designed so that when the coolant temperature is relatively low, the coolant passageway between the radiator 3 and the electric coolant pump 2 is shut down so as to keep the coolant from flowing into the radiator 3 (the engine coolant passageway 201). On the other hand, when the warm-up of the engine 1 has been completed, that is, when the coolant temperature is relatively high, the thermostat 4 operates (opens its valve) according to the coolant temperature so as to allow a part of the coolant to flow into the radiator 3, so that heat recovered by the coolant is released from the radiator 3 into the atmosphere. Incidentally, in this embodiment, the thermostat 4 has been set so as to open when the ambient coolant temperature of the temperature sensitive portion (=the wax temperature) reaches a coolant temperature (e.g., 82° C. or higher) that is higher than the valve opening temperature of the changeover valve 10 (e.g., 70° C.) described later.

The heater passageway 202 is a bypass passageway that bypasses the engine 1. The EGR cooler 7, the exhaust heat recovery device 6 and the heater 5 are connected in series on the heater passageway 202, in that order from the upstream side in terms of the flow of the coolant. The coolant discharged from the electric coolant pump 2 circulates in the order of "the EGR cooler 7→the exhaust heat recovery device 6→the heater 5→the thermostat 4→the electric coolant pump 2". A heater connection passageway 202*a* is connected to the heater passageway 202 between the EGR cooler 7 and the exhaust heat recovery device 6. The heater connection passageway 202*a* is connected, via the changeover valve 10, to a coolant outlet 1*b* of the engine 1 (a coolant jacket outlet of the cylinder head). The changeover valve (control valve) 10 opens and closes the heater connection passageway 202*a*. Details of the changeover valve 10 will be described later.

The heater 5 is a heat exchanger for heating a cabin of the vehicle by utilizing heat of the coolant, and is disposed facing a blow duct of the air-conditioner. Specifically, a design is made such that when the cabin is heated (when the heater is on), the air-conditioned air that flows in the blow duct is passed through the heater 5 (a heater core) and the obtained warmed air is supplied into the cabin, and such that in the other times (e.g., during the cooling) (when the heater is off), the air-conditioned air bypasses the heater 5. On the heater 5, there is disposed a heater inlet coolant temperature sensor 22. An output signal of the heater inlet coolant temperature sensor 22 is input to the ECU 300. Incidentally, since the inlet coolant temperature of the heater 5 is equivalent to the temperature of the coolant that flows in the heater passageway 202 (bypass passageway), the heater inlet coolant temperature sensor 22 corresponds to a bypass coolant temperature sensor.

The exhaust heat recovery device 6 is a heat exchanger that is disposed on an exhaust passageway of the engine 1 for the purpose of recovering heat from the exhaust gas by using the coolant. The heat recovered by the exhaust heat recovery device 6 is utilized for the warm-up of the engine and the heating of the cabin. The EGR cooler 7 is a heat exchanger that is disposed on an EGR passageway that returns a part of the exhaust gas that flows in the exhaust passageway of the engine 1 to an intake passageway for the purpose of cooling the EGR gas that passes (refluxes) in the EGR passageway.

Next, the changeover valve 10 for use in the cooling system will be described with reference to FIGS. 2A and 2B.

The changeover valve 10 in this embodiment includes a housing 11, a valve body 12, a compression coil spring 13, a temperature sensitive portion 14, etc.

The housing 11 is provided with a coolant inlet 1*a* that is connected to the coolant outlet (the coolant jacket opening of the cylinder head) 1*b* of the engine 1 shown in FIG. 1, a radiator connection opening 11*b* that is connected to the radiator 3, and a heater connection opening 11*c*. The heater connection opening 11*c* is connected to the heater passageway 202 via the heater connection passageway 202*a* shown in FIG. 1.

Inside the housing 11, a valve seat 111 and a spring seat 112 are provided, facing each other. A space between the valve seat 111 and the spring seat 112 (a space on an upstream side of the valve body 12) forms a coolant lead-in portion 11*d*. The coolant inlet 11*a* communicates with the coolant lead-in portion 11*d*. Via the coolant lead-in portion 11*d*, the radiator connection opening 111*b* communicates with the coolant inlet 11*a*. Besides, a space on a downstream side of the valve body 12 forms a coolant lead-out portion 11*e* with which the heater connection opening 11*c* communicates.

The valve body 12 is disposed between the valve seat 111 and the spring seat 112 inside the housing 11 so as to be able to contact the valve seat 111 and separate therefrom. This valve body 12 and a case 141 of the temperature sensitive portion 14 (described later) are integrated together. Besides, the compression coil spring 13 is placed between the valve body 12 and the spring seat 112. Due to the elastic force of the compression coil spring 13, the valve body 12 is urged toward the valve seat 111.

The temperature sensitive portion (temperature sensitive actuator) 14 includes a case 141 and a rod 142. The rod 142 is a rod-shape member extending in the opening-closing direction of the valve body 12, and disposed freely slidably relative to the case 141. The rod 142 penetrates the valve body 12. The valve body 12 is slidable in the opening-closing direction relative to the rod 142. Besides, a distal end portion of the rod 142 penetrates a wall body 11*f* of the housing 11 (a wall body at the opposite side to the coolant inlet 11*a*), and the distal end portion is retained by a rod retainer member 16.

An interior of the case 141 of the temperature sensitive portion 14 is filled with a thermo-wax 143 that expands and contracts due to changes in the ambient coolant temperature of the temperature sensitive portion 14 (hereinafter, also referred to as changeover valve's ambient coolant temperature) (i.e., changes in the wax temperature). The expansion and contraction of the thermo-wax 143 changes the amount of protrusion of the rod 142 relative to the case 141. Incidentally, the thermo-wax 143 is housed within a seal member 144 that is made of rubber or the like.

Figure 2A:
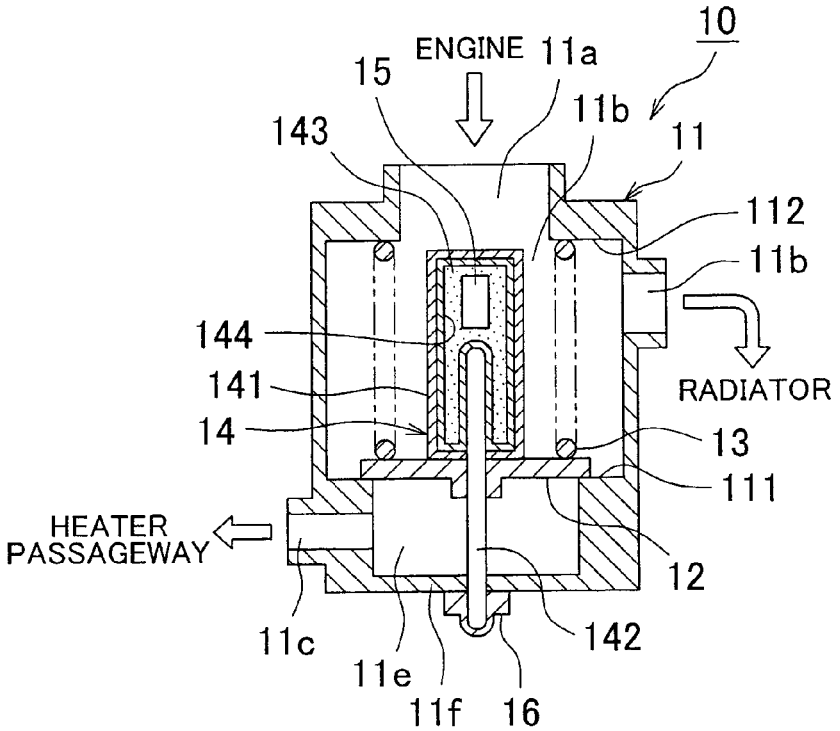
FIG. 2A is a sectional view showing a structure of a changeover valve for use in the cooling system shown in FIG. 1, and showing a closed valve state of the changeover valve.
Figure 2B:
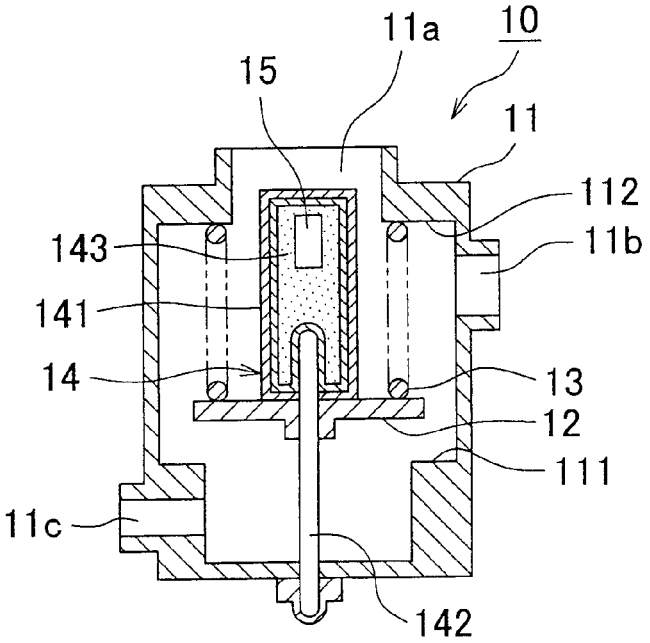
FIG. 2B is a sectional view showing a structure of the changeover valve for use in the cooling system shown in FIG. 1, and showing an open valve state of the changeover valve.

In the changeover valve 10 having a structure as described above, when the changeover valve's ambient coolant temperature (=the wax temperature) Tvw is lower than a predetermined value (70° C. in this embodiment), there occurs a state in which the amount of protrusion of the rod 142 from the case 141 is small (i.e., the amount of immersion of the rod 142 in the case 141 is large) so that the valve body 12 is seated on the valve seat 111 (i.e., is closed) by the elastic force of the compression coil spring 13 (FIG. 2A). When, from this closed valve state, the changeover valve's ambient coolant temperature Tvw becomes equal to or higher than the predetermined value (equal to or higher than 70° C.), the thermo-wax 143 of the temperature sensitive portion 14 expands. Due to the expansion of the thermo-wax 143, the amount of protrusion of the rod 142 from the case 141 increases, the entire temperature sensitive portion 14, that is, the valve body 12, moves in a direction away from the valve seat 111, overcoming the elastic force of the compression coil spring 13, so that the valve body 12 separates from the valve seat 111 (opens) (FIG. 2B).

Thus, when the changeover valve's ambient coolant temperature Tvw is lower than the predetermined value (70° C.), the changeover valve 10 in this embodiment assumes a closed state, in which the coolant outlet 1*b* of the engine 1 (the engine coolant passageway 201) shown in FIG. 1 and the heater passageway 202 shown in FIG. 1 are shut off from each other (the circulation of the coolant between the engine coolant passageway and the bypass passageway is restricted). On the other hand, when the changeover valve's ambient coolant temperature Tvw is greater than or equal to the predetermined value (greater than or equal to 70° C.), the changeover valve 10 assumes an open valve state, in which the coolant outlet 1*b* of the engine 1 (the engine coolant passageway 201) and the heater passageway 202 shown in FIG. 1 communicate with each other. Incidentally, when the thermostat 4 shown in FIG. 1 is in the closed valve state although the coolant inlet 11*a* and the radiator connection opening 11*b* communicate with each other, the coolant having flown into the coolant inlet 11*a* does not flow into the radiator connection opening 11*b*.

It is to be noted herein that in the changeover valve 10 in this embodiment, an electric heater 15 is buried within the temperature sensitive portion 14. By electrifying the electric heater 15 so that heat generated by the electric heater 15 melts the thermo-wax 143, the changeover valve 10 can be forced to assume the open state. The opening of the changeover valve 10 due to the heater electrification is performed during a coolant temperature sensor abnormality determination process described later (at the time of the second rationality determination to be performed), or the like. Incidentally, the electric heater 15 of the changeover valve 10 is operated by a changeover valve controller (not shown). The changeover valve controller performs electrification of the electric heater 15 of the changeover valve 10 according to a valve opening request from the ECU 300.

The flow of the coolant circulating through the coolant passageway of the cooling system of the engine 1 shown in FIG. 1 will be described with reference to FIG. 3 and FIG. 4.

Figure 3A:
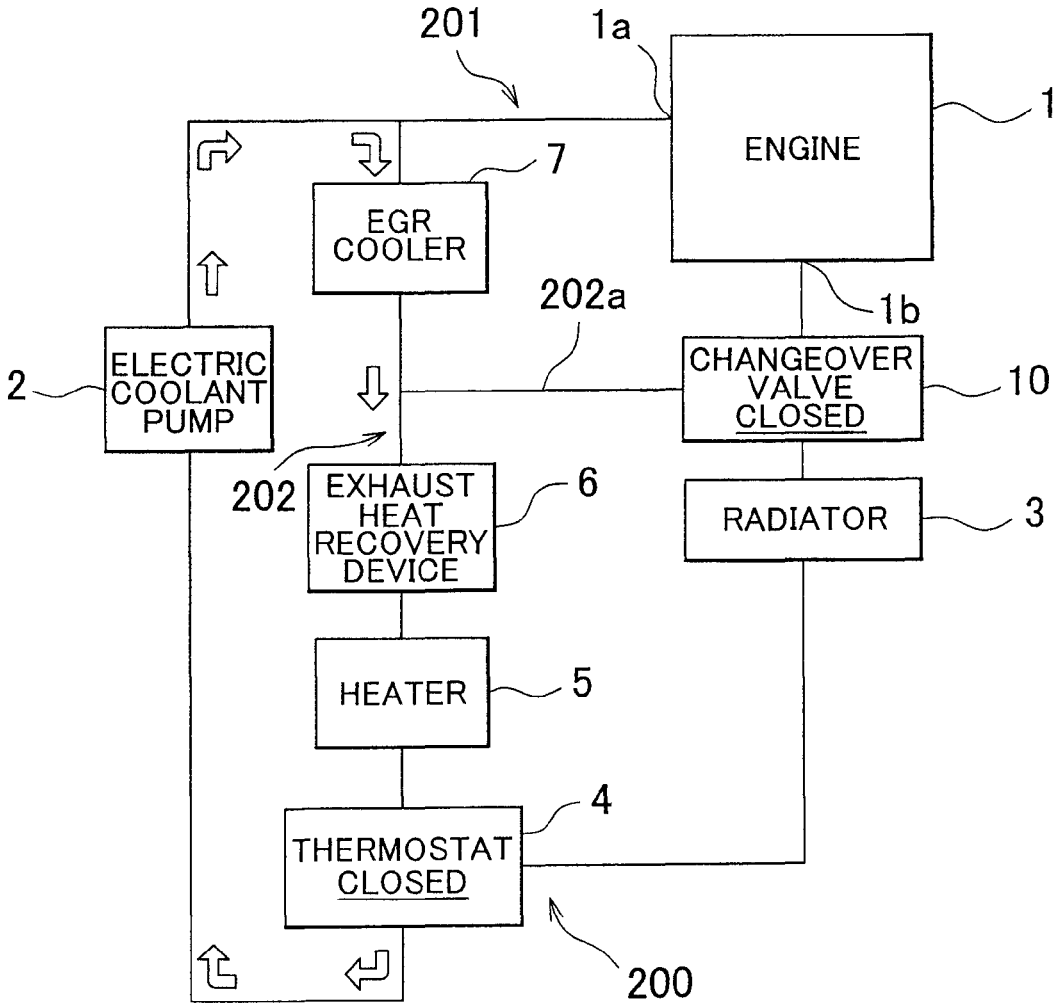
FIG. 3A is a diagram showing the flow of the coolant circulating in a coolant passageway during a cold state of the engine in the cooling system of the engine shown in FIG. 1.

Firstly, during the cold state of the engine, since the ambient coolant temperature Tvw of the temperature sensitive portion 14 of the changeover valve 10 is low (less than 70° C.), the changeover valve 10 assumes the closed state, so that the passage of the coolant within the engine 1 (within the coolant jacket) is stopped (in-engine coolant stop). Due to this, the engine 1 is quickly warmed up. Besides, when the changeover valve 10 is in the closed state, the coolant circulates through the heater passageway 202 as shown in FIG. 3A due to operation of the electric coolant pump 2, and the coolant flows in the sequence of "the electric coolant pump 2→the EGR cooler 7→the exhaust heat recovery device 6→the heater 5→the thermostat 4→the electric coolant pump 2". If there is a cabin→heating request during the quick warm-up as described above, it suffices that the amount of heat needed for the heater 5 is covered by the heat that is recovered by the exhaust heat recovery device 6.

Figure 3B:
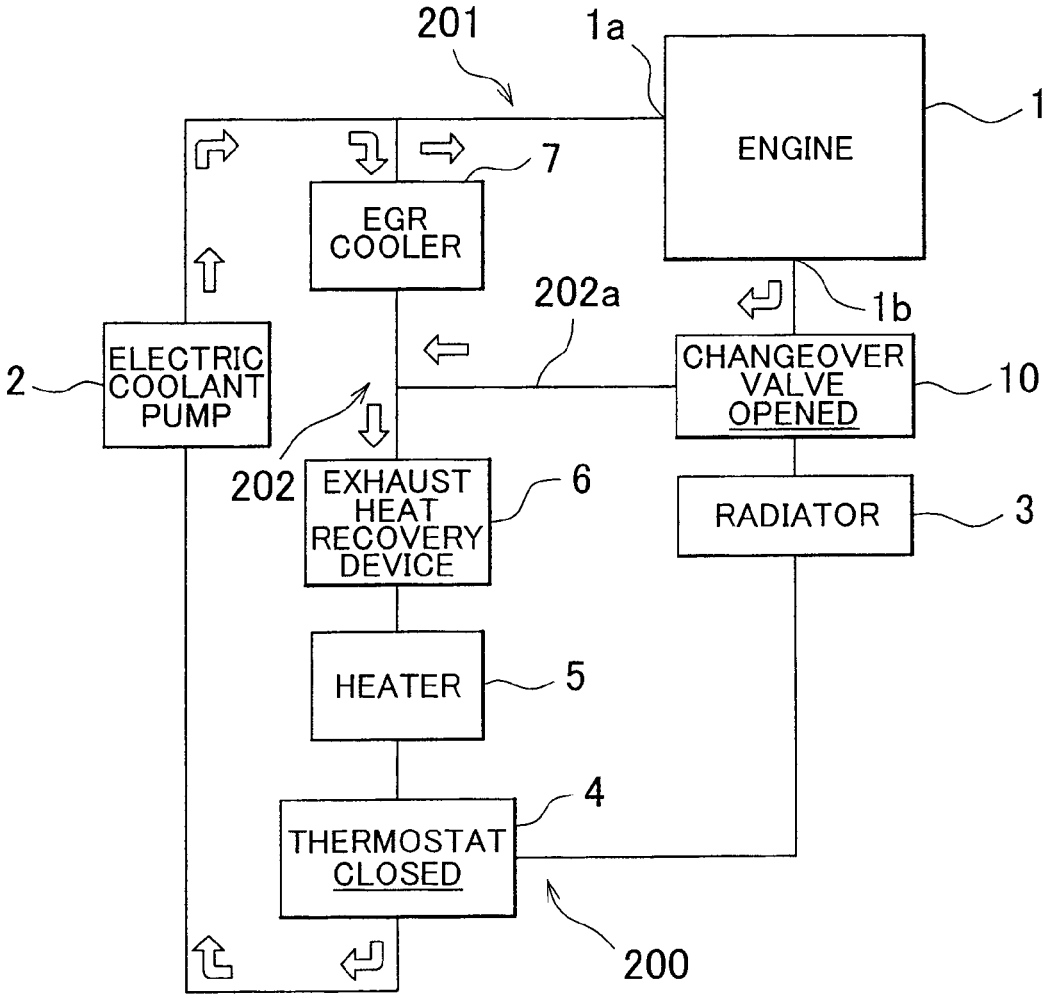
FIG. 3B is a diagram showing the flow of the coolant circulating in the coolant passageway during a semi-warmed-up state of the engine in the cooling system of the engine shown in FIG. 1.

Next, when the engine 1 becomes semi-warmed up and the ambient coolant temperature Tvw of the temperature sensitive portion 14 of the changeover valve becomes equal to or higher than the predetermined value (equal to or higher than 70° C.), the changeover valve 10 opens. When the changeover valve 10 is open, the coolant flows in the sequence of "the electric coolant pump 2→the coolant inlet 1*a* of the engine 1→the inside of the engine 1 (within the coolant jacket)→the coolant outlet 1*b* of the engine 1→the changeover valve 10→the heater connection passageway 202*a*", in addition to the circulation of the coolant in the heater passageway 202, as shown in FIG. 3B, so that the engine 1 is cooled. Besides, when the changeover valve 10 assumes the open state, the coolant in the engine coolant passageway 201 (in the engine 1) and the coolant in the heater passageway (bypass passageway) 202 are mixed.

Figure 4:
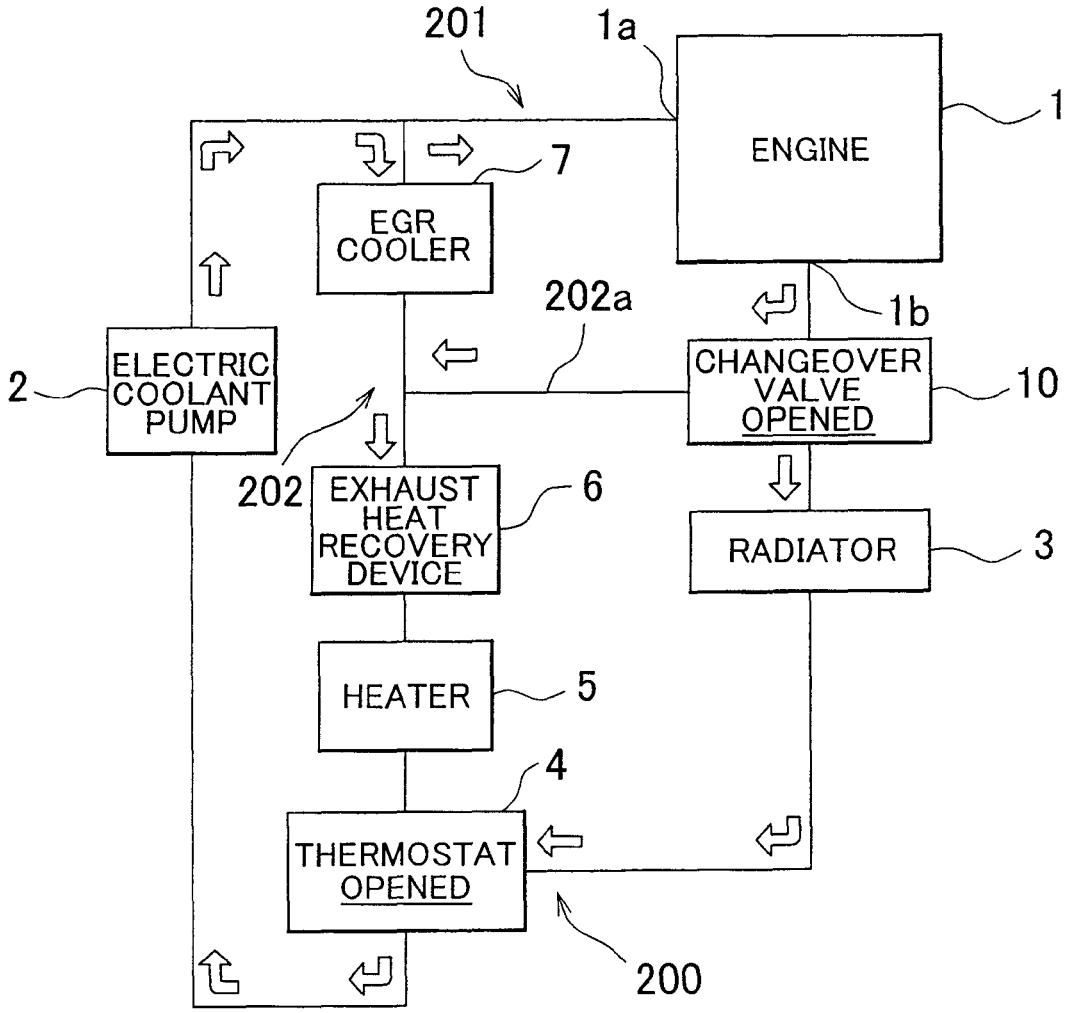
FIG. 4 is a diagram showing the flow of the coolant circulating in the coolant passageway during a completely warmed-up state of the engine in the cooling system of the engine shown in FIG. 1.

Then, when the engine 1 reaches a completely warmed-up state, the thermostat 4 operates (opens its valve) so that a portion of the coolant flows into the radiator 3, as shown in FIG. 4, and therefore heat recovered by the coolant is released from the radiator 3 into the atmosphere.

Next, the ECU 300 will be described. The ECU 300 includes a CPU, a ROM, a RAM, a back-up RAM, etc. The ROM stores various control programs, maps that are referred to at the time of execution of the various control programs, etc. The CPU executes computation processes on the basis of the various control programs or maps stored in the ROM. Besides, the RAM is a memory for temporarily storing results of computations by the CPU, data input from various sensors, etc. The back-up RAM is a non-volatile memory for storing data or the like that needs to be stored, when the engine 1 is stopped.

The ECU 300 is connected to various sensors that detect states of operation of the engine 1, including the engine coolant temperature sensor 21, the intake air temperature sensor 23 and the engine rotation speed sensor 24, as shown in FIG. 1. Besides, the ECU 300 is also connected to the heater inlet coolant temperature sensor 22, an ignition switch (not shown), etc.

The ECU 300, on the basis of output signals from various sensors that detect the states of operation of the engine, executes various controls of the engine 1 that include an opening degree control of a throttle valve of the engine 1, a fuel injection amount control (an opening/closing control of injectors), etc. Besides, the ECU 300 also executes a "coolant temperature sensor abnormality determination process" described below.

Next, the coolant temperature sensor abnormality determination process will be described.

EXAMPLE 1 OF DETERMINATION PROCESS

An example of the abnormality determination process for the engine coolant temperature sensor 21 will be described with reference to a flowchart shown in FIG. 5. The process routine shown in FIG. 5 is executed by the ECU 300.

Figure 5:
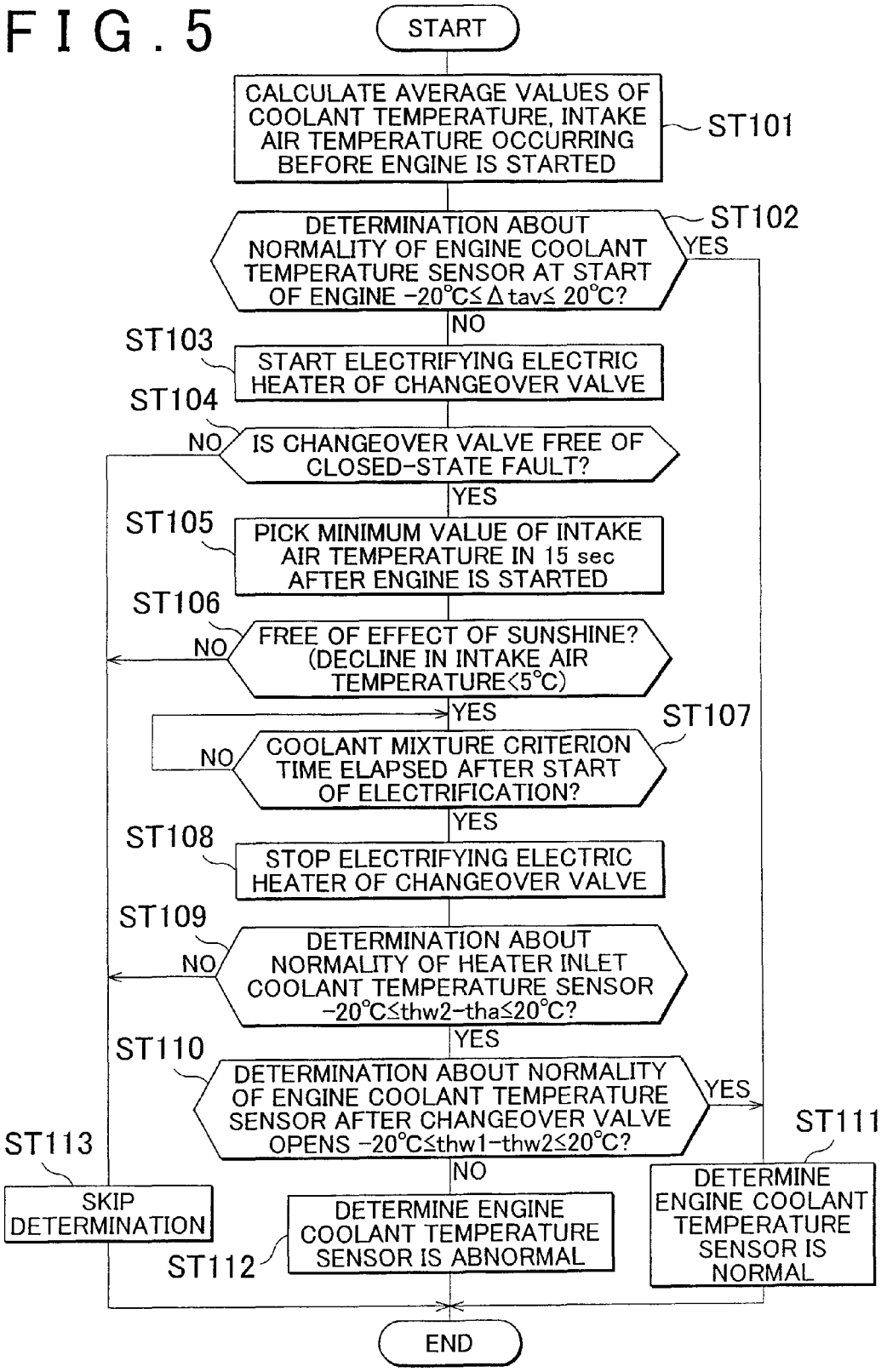
FIG. 5 is a flowchart showing an example of a coolant temperature sensor abnormality determination process that an ECU executes in the embodiment of the invention.

Incidentally, during execution of the process routine of FIG. 5, the ECU 300 continually recognizes the engine coolant temperature thw1, the heater inlet coolant temperature thw2 and the intake air temperature tha (e.g., recognizes them in a cycle of several milliseconds to several ten milliseconds), from output signals of the engine coolant temperature sensor 21, the heater inlet coolant temperature sensor 22 and the intake air temperature sensor 23.

The process routine shown in FIG. 5 is started at the time point (IG-ON) when the ignition switch is turned on. When the process routine shown in FIG. 5 is started, the ECU 300 firstly calculates an average value of the engine coolant temperature thw1 and an average value of the intake air temperature tha occurring before the start of the engine (during the time from IG-ON to the start of the engine (initial combustion)) in ST101.

In step ST102, the ECU 300 determines whether the engine coolant temperature sensor 21 is normal by the rationality determination between the engine coolant temperature thw1 and the intake air temperature tha. Concretely, the ECU 300 calculates a temperature difference Δtav between the average value of the engine coolant temperature thw1 and the average value of the intake air temperature tha calculated in step ST101, and determines whether the temperature difference Δtav is in a predetermined range. In this example, the ECU 300 determines whether −20° C.≤Δtav≤20° C. If the result of the determination is an affirmative determination (YES), the ECU 300 determines that the engine coolant temperature sensor 21 is normal (step ST111). If the result of the determination in step ST102 is a negative determination (NO) (|Δtav|>20° C.), the ECU 300 proceeds to step ST103.

If the result of the determination in step ST102 is a negative determination (NO), the ECU 300 cannot determine whether there is present a situation in which "the engine coolant temperature sensor 21 is abnormal" or a situation in which "the block heater 8 has been attached". Therefore, in this example, the normality or abnormality of the engine coolant temperature sensor 21 is determined by the rationality determination between the engine coolant temperature thw1 and the heater inlet coolant temperature thw2. This determination process will be described later. Incidentally, the rationality determination is a logic for checking whether a plurality of sensor values (detected temperature values) are equivalent in a situation where the sensor values (detected temperature values) ought to be equivalent.

If the result of the determination in step ST102 is a negative determination, the ECU 300 starts electrification of the electric heater 15 of the changeover valve 10 by outputting a valve opening request to the changeover valve controller (step ST103). Incidentally, the ECU 300 counts the elapsed time from the time point of starting electrification of the electric heater 15 of the changeover valve 10.

Next in step ST104, the ECU 300 determines whether "the changeover valve is free of a closed-state fault". If the result of the determination is an affirmative determination (YES), the ECU 300 proceeds to step ST105. If the result of the determination in step ST104 is a negative determination (NO), the ECU 300 does not perform the determination regarding the normality or abnormality of the engine coolant temperature sensor 21 (step ST 113, in which the determination is skipped). Incidentally, the term "closed-state fault" herein refers to a fault in which the valve is in a closed state and is not able to be opened.

An example of the determination process in step ST104 will be concretely described. In the case where the changeover valve 10 has the closed-state fault, since the coolant in the engine coolant passageway 202 (in the engine 1) and the coolant in the heater passageway 202 do not mix even if the electrification of the heater is performed, the amount of increase (rate of change) in the heater inlet coolant temperature thw2 detected by the heater inlet coolant temperature sensor 22 corresponds to the heat that is recovered by the exhaust heat recovery device 6, and is smaller than the amount of increase (rate of change) in the heater inlet coolant temperature thw2 that occurs in the case where the changeover valve 10 is normal (the case where the high-temperature coolant from the engine 1 mixes with the coolant in the heater passageway 202). Utilizing these facts, if the amount of increase (° C./sec) in the heater inlet coolant temperature thw2 detected by the heater inlet coolant temperature sensor 22 after the heater is electrified is greater than or equal to a predetermined value, the ECU 300 determines that "the changeover valve is free of the closed-state fault", and proceeds to step ST 105. The determination regarding the normality of the heater inlet coolant temperature sensor 22 will be described later.

Incidentally, in the case where the changeover valve 10 is equipped with a sensor that detects the amount of valve lift, the presence or absence of the "closed-state fault of the changeover valve" may be determined on the basis of a detected value provided by the valve lift sensor.

In step ST105, the ECU 300 picks a minimum value of the intake air temperature tha during the period of 15 seconds following the start of the engine, and then calculates the amount of decline in the intake air temperature that occurs during the period (15 seconds).

In step ST106, the ECU 300 determines whether it is "free of the effect of sunshine". If the result of the determination is an affirmative determination (YES), the ECU 300 proceeds to step ST107. If the result of the determination in step ST106 is a negative determination (NO), the ECU 300 does not perform the determination regarding the normality or abnormality of the engine coolant temperature sensor 21 (step ST113, in which the determination is skipped). That is, in the case where there is effect by sunshine (the case where sunshine has warmed the interior of the engine compartment), the intake air temperature tha and the engine coolant temperature thw1 are different from each other, and therefore there is a possibility of falsely determining that the engine coolant temperature sensor 21 is abnormal. Hence, in that case, the determination is avoided.

Next, the determination process in step ST106 will be concretely described. If sunshine has warmed the interior of the engine compartment (if there is an effect of sunshine) prior to the starting of the engine, the actual intake air temperature is high during an initial period of a trip (a vehicle operation period from the starting of the engine to a stop thereof), and as time passes after the engine is started, the intake air temperature tha detected by the intake air temperature sensor 23 declines (as external air flows into the intake passageway after the engine is started, the intake air temperature tha declines). On the other hand, in the case where there is no effect of sunshine, the decline in the intake air temperature tha after the engine is started is small (or the decline in the intake air temperature tha does not occur). Taking these points into account, in step ST 106 in this example, the ECU 300 determines whether the amount of decline in the intake air temperature calculated in step ST105 is less than 5° C., and if the result of the determination is a negative determination (NO) (if the amount of decline in the intake air temperature≥5° C.), the determination is skipped, that is, not performed (step ST113). If the result of the determination in step ST106 is an affirmative determination (YES) (if the amount of decline in the intake air temperature<5° C.), the ECU 300 determines that it is "free of the effect of sunshine", and proceeds to step ST 107. Incidentally, the criterion value for determining that it is "free of the effect of sunshine" may also be a value other than "5° C.".

In step ST107, the ECU 300 determines whether a coolant mixture criterion time has elapsed following the time point of starting the electrification of the electric heater 15 of the changeover valve 10. The "coolant mixture criterion time" for use in the process of step ST107 is adapted on the basis of the amount of time from the start of the electrification of the electric heater 15 to the actual opening of the changeover valve 10 and the amount of time from the opening of the changeover valve 10 to when the coolant in the engine coolant passageway 201 (in the engine 1) and the coolant in the heater passageway 202 sufficiently mix.

Concretely, on the basis of a condition in which it takes the longest time from when the electric heater 15 of the changeover valve 10 starts to be electrified to when the changeover valve 10 is opened (e.g., a condition in which the idling operation is being performed and the engine is in a low-temperature environment), the time time1 (see FIG. 6) needed for opening the changeover valve 10 is adapted by experiments, simulation, etc. Besides, as for the time time2 needed for sufficient mixture of the coolant in the engine coolant passageway 201 (in the engine 1) and the coolant in the heater passageway 202 (see FIG. 6), the time time2 is inversely proportional to the amount of flow of the coolant in the engine 1 occurring after the changeover valve 10 is opened, and therefore this point is taken into account in adapting the time time2 on the basis of experiments, simulations, etc. A value (time1+time2) obtained by summing the adapted time time1 needed for opening the valve and the adapted time time2 needed for mixing the coolant is set as a "coolant mixture criterion time" for use in the determination process of step ST 107.

Then, at the time point when the elapsed time following the start of the electrification of the electric heater 15 reaches the aforementioned coolant mixture criterion time (the time point when the result of the determination in step ST107 is found to be an affirmative determination (YES)), the ECU 300 discontinues the changeover valve-opening request, and stops the electrification of the electric heater 15 of the changeover valve 10 (step ST108), and then proceeds to step ST109.

In step ST109, the ECU 300 determines whether the heater inlet coolant temperature sensor 22 is normal. Concretely, the ECU 300 calculates a difference (thw2−tha) between the heater inlet coolant temperature thw2 and the intake air temperature tha, and then determines whether the temperature difference (thw2−tha) is within a predetermined range (the rationality determination between thw2 and tha). In this example, the ECU 300 determines whether "−20° C.≤thw2−tha≤20° C.". If the result of the determination is a negative determination (NO) (if |thw2−tha|>20° C.), the ECU 300 does not perform the determination regarding the normality or abnormality of the engine coolant temperature sensor 21 (step ST113). If the result of the determination in step ST109 is an affirmative determination (YES) (if −20° C.≤thw2−tha≤20° C.), the ECU 300 determines that the heater inlet coolant temperature sensor 22 is normal, and proceeds to step ST110.

Incidentally, as for the heater inlet coolant temperature sensor 22, since the sensor is not warmed by the block heater 8 as is apparent from the construction shown in FIG. 1, it is possible to determine whether the heater inlet coolant temperature sensor 22 is normal, during the initial period of the trip, by the rationality determination between the heater inlet coolant temperature thw2 and the intake air temperature tha. Besides, if the rationality determination between the heater inlet coolant temperature thw2 and the intake air temperature tha results in the determination of the presence of normality, it can be said that the intake air temperature sensor 23 is also normal.

In step ST110, by the rationality determination between the engine coolant temperature thw1 and the heater inlet coolant temperature thw2, it is determined whether the engine coolant temperature sensor 21 is normal or abnormal.

Concretely, the temperature difference (thw1−thw2) between the engine coolant temperature thw1 and the heater inlet coolant temperature thw2 is calculated, and then it is determined whether the temperature difference (thw1−thw2) is within a predetermined range. In this example, it is determined whether −20° C.≤thw1−thw2≤20° C. If the result of the determination is an affirmative determination (YES), it is determined that the engine coolant temperature sensor 21 is normal (step ST111). If the result of the determination in step ST110 is a negative determination (NO) (if |thw1−thw2|>20° C.), it is determined that the engine coolant temperature sensor 21 is abnormal (step ST112).

Next, the determination process in step ST110 will be concretely described with reference to FIG. 6. Incidentally, FIG. 6 shows changes in the detected coolant temperature values thw1 and thw2 in the case where the engine coolant temperature sensor 21 and the heater inlet coolant temperature sensor 22 are normal.

Figure 6:
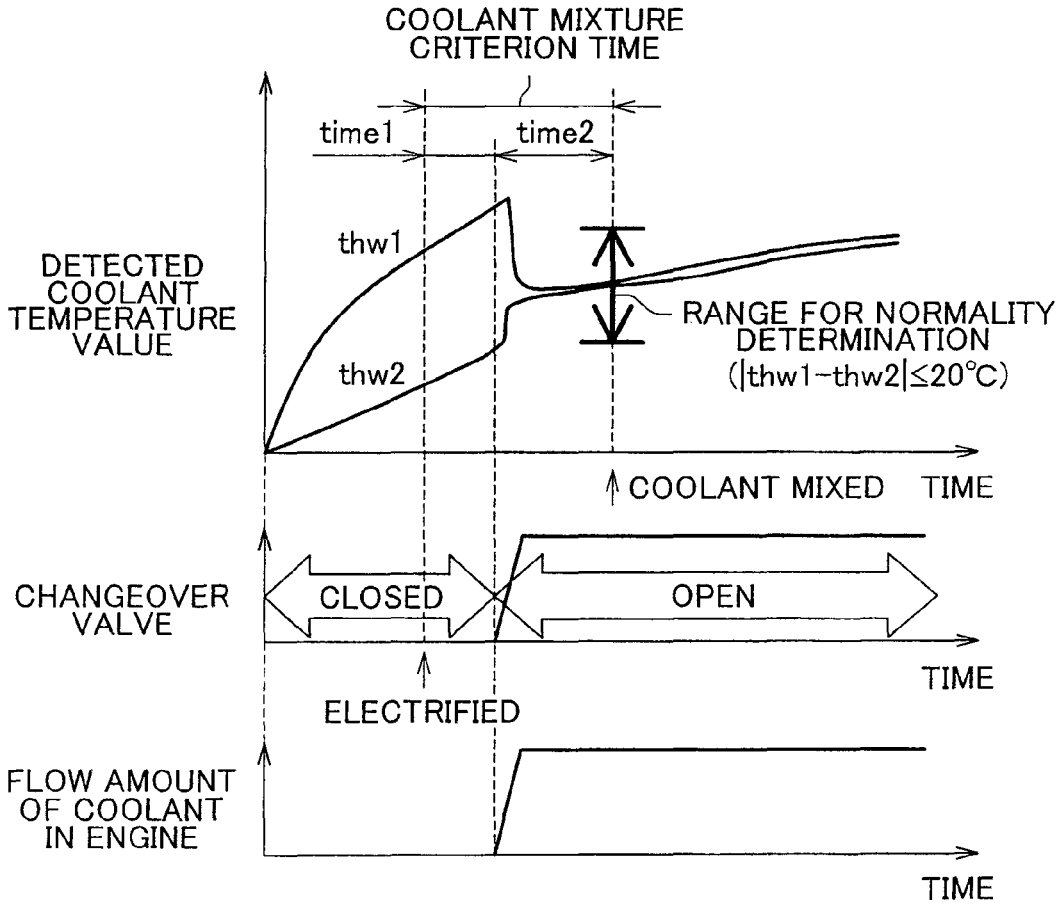
FIG. 6 is a timing chart showing an example of the coolant temperature sensor abnormality determination process in the embodiment of the invention.

In the case where the engine has been started and the changeover valve is in the closed state (an in-engine coolant stop state), as the engine is warmed, the engine coolant temperature thwr1 (actual engine coolant temperature) greatly increases whereas the degree of increase in the heater inlet coolant temperature thwr2 (the actual heater inlet coolant temperature) is small (e.g., about as small as the degree of increase in the temperature caused by the heating provided by the exhaust heat recovery device 6), so that the actual engine coolant temperature thwr1 and the actual heater inlet coolant temperature thwr2 depart from each other (see the detected coolant temperature values thw1 and thw2 in FIG. 6).

Next, as the changeover valve 10 actually opens after the electric heater of the changeover valve 10 starts to be electrified, the actual engine coolant temperature thwr1 and the actual heater inlet coolant temperature thwr2 become closer to each other. Then, when the coolant in the engine coolant passageway 201 (in the engine 1) and the coolant in the heater passageway 202 become sufficiently mixed, the actual engine coolant temperature thwr1 and the actual heater inlet coolant temperature thwr2 become substantially equal. At this time, if the engine coolant temperature sensor 21 is normal (it is to be noted that the heater inlet coolant temperature sensor 22 has already been determined as being normal in step ST109 in FIG. 5), the engine coolant temperature thw1 detected by the engine coolant temperature sensor 21 and the heater inlet coolant temperature thw2 detected by the heater inlet coolant temperature sensor 22 become close to each other (or equal to each other) as shown in FIG. 6. On the other hand, if the engine coolant temperature sensor 21 is abnormal, the engine coolant temperature thw1 detected by the engine coolant temperature sensor 21 departs from the heater inlet coolant temperature thw2 detected by the heater inlet coolant temperature sensor 22 even when the coolant in the engine 1 and the coolant in the heater passageway 202 become sufficiently mixed.

In view of these points, in this example, if the difference between the engine coolant temperature thw1 (detected value) and the heater inlet coolant temperature thw2 (detected value) occurring when the coolant in the engine 1 and the coolant in the heater passageway 202 become sufficiently mixed is within the predetermined range (−20° C.≤thw1−thw2≤20° C.), it is determined that the engine coolant temperature sensor 21 is normal, and if the temperature difference between the two coolant temperatures is outside the predetermined range, that is, |thw1−thw2|>20° C., it is determined that the engine coolant temperature sensor 21 is abnormal.

Then, in the case where it is determined that the engine coolant temperature sensor 21 is not normal by the rationality determination between the engine coolant temperature thw1 and the intake air temperature tha (the first determination to be made) (i.e., the case where it cannot be determined whether the present situation is the situation in which "the engine coolant temperature sensor 21 is abnormal" or the situation in which "the block heater 8 has been attached"), it is possible to determine whether the engine coolant temperature sensor 21 is normal or abnormal by performing the second rationality determination, that is, the rationality determination between the engine coolant temperature thw1 and the heater inlet coolant temperature thw2.

As described above, according to the abnormality determination process of this example, when the temperature difference between the intake air temperature tha detected by the intake air temperature sensor 23 (that corresponds to the atmospheric temperature around the engine) and the engine coolant temperature thw1 detected by the engine coolant temperature sensor 21 is greater than the predetermined value, the changeover valve 10 is opened to mix the coolant in the engine coolant passageway 201 (in the engine 1) and the coolant in the heater passageway 202 (i.e., to cause the coolant to flow into the engine 1) so that the coolant temperature environments of the engine coolant temperature sensor 21 and of the heater inlet coolant temperature sensor 22 become equal, and after such a state has been obtained, the determination regarding the engine coolant temperature sensor 21 is performed on the basis of the engine coolant temperature thw1 and the heater inlet coolant temperature thw2 detected by the two coolant temperature sensors 21 and 22. Therefore, the presence of abnormality of the engine coolant temperature sensor 21 can be precisely determined without making a false determination.

Incidentally, although in the aforementioned example, the process routine shown in FIG. 5 is started at the time point (IG-ON) when the ignition switch is turned on, the process routine shown in FIG. 5 may also be started when there is an engine-starting request in the case where the vehicle equipped with the engine 1 is a hybrid vehicle.

EXAMPLE 2 OF DETERMINATION PROCESS

Although in the example 1 of the determination process, it is determined that the changeover valve 10 has opened, at the time point when a certain time (time time1) elapses following the start of electrification of the electric heater 15 of the changeover valve 10, it is also permissible to estimate the ambient coolant temperature Tvw of the temperature sensitive portion 14 of the changeover valve 10, and determine whether the changeover valve 10 has opened on the basis of the estimated value of the changeover valve's ambient coolant temperature Tvw.

Figure 7:
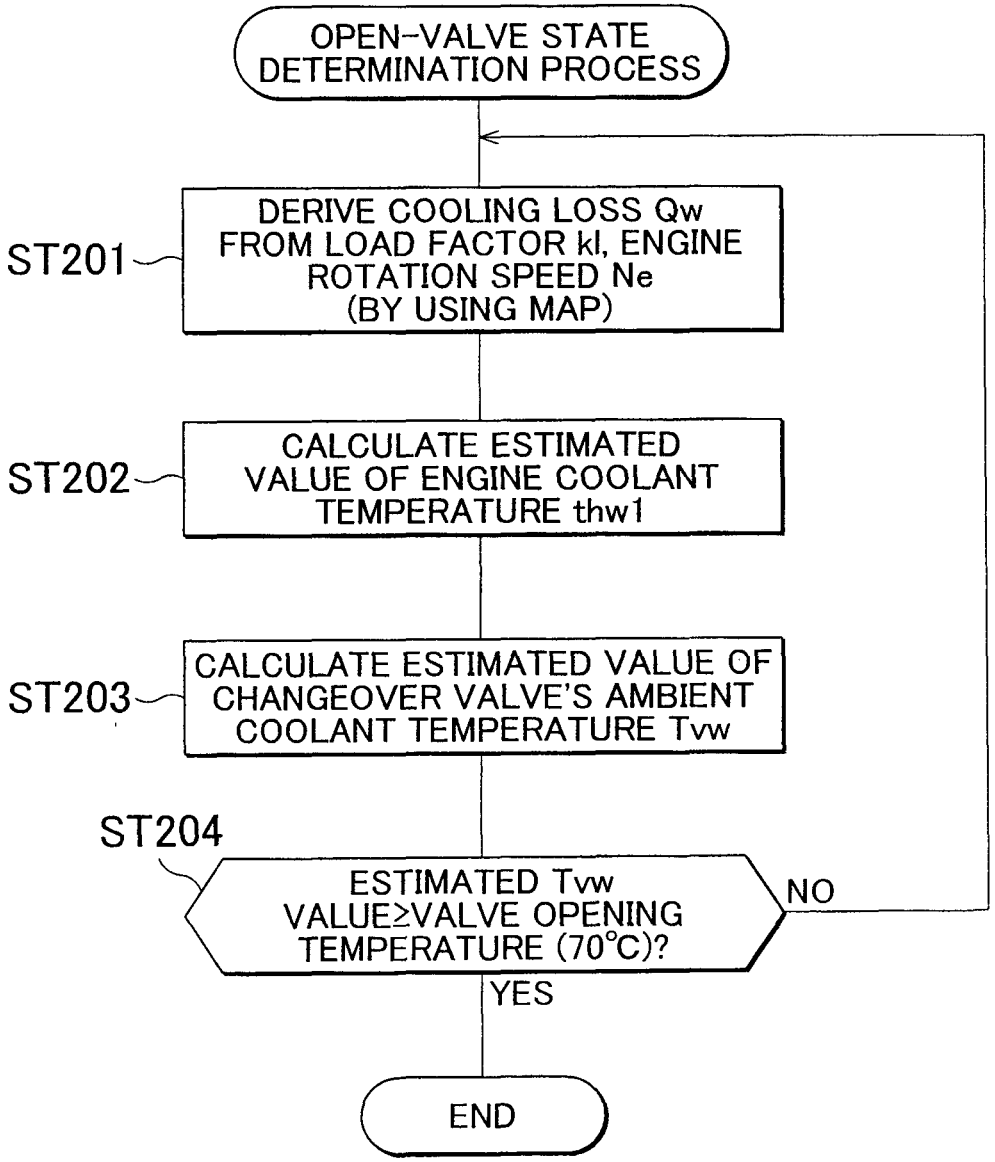
FIG. 7 is a flowchart showing an example of a process of determining whether the changeover valve has opened in the embodiment of the invention.

A concrete example thereof (an open-valve state determination process) will be described with reference to a flowchart shown in FIG. 7. The process routine shown in FIG. 7 is executed by the ECU 300.

Firstly in step ST201, the ECU 300 calculates a cooling loss Qw in the engine 1 with reference to a map adapted beforehand by experiments, simulations, etc., on the basis of the engine rotation speed Ne and the load factor k1 calculated from output signals of the engine rotation speed sensor 24. Incidentally, the load factor k1 can be calculated, for example, as a value that indicates the proportion of the present load to the maximum engine load, by referring to a map or the like on the basis of the engine rotation speed Ne and the intake pressure.

In step ST202, using the cooling loss Qw calculated in step ST201, the ECU 300 calculates an estimated value of the engine coolant temperature thw1 on the basis of the following expression (1), that is, a Laplace transform expression of the engine coolant temperature thw1. Next, in step ST203, using the estimated value of the engine coolant temperature thw1 calculated in step ST202, the ECU 300 calculates an estimated value of the changeover valve's ambient coolant temperature Tvw from the following expression (2), and then determines whether the estimated value of the changeover valve's ambient coolant temperature Tvw has reached a valve-opening temperature (70° C.) of the changeover valve 10 (step ST204).

The above-described process of steps ST201 to ST203 is repeated at every predetermined time (e.g., several milliseconds to several ten milliseconds) until the result of the determination in step ST204 is an affirmative determination, and at the time point when the affirmative determination (YES) is made in step ST204, it is determined that the changeover valve 10 has opened. Then, after the set time time2 (a time needed from the opening of the changeover valve 10 to the attainment of sufficient mixture of the coolant) elapses following the time point when it is determined that the valve 10 has opened, the determination regarding the normality or abnormality of the engine coolant temperature sensor 21 is performed (the determination process in step ST110 in FIG. 5 is executed).

$$\mathcal{L}(thwl) = \frac{\frac{L}{\lambda A}}{\left(\frac{CL}{\lambda A}\right)^2 S^2 + \frac{2CL}{\lambda A} S} \mathcal{L}(Qw(kl, Ne)) \tag{1}$$

$\mathcal{L}$ (_____): Laplace transform
C: heat capacity [J/° C.]
λ: heat conductivity between thermal points [W/(m° C.)]
L: distance between thermal points [m]
A: heat conduction area between thermal points [$m^2$]

$$thwl - Tvw = \frac{\alpha}{\beta s + 1} \tag{2}$$

α and β: constants

Herein, the parameters C, λ, L and A in the foregoing expression (1) are set at values that are adapted on the assumption of a coolant mass around a highest-temperature portion in the coolant jacket of the cylinder head during a stop of the coolant in the engine 1.

As described above, according to the open-valve state determination process of this example, since the presence of an open state of the changeover valve 10 is determined on the basis of the estimated value of the changeover valve's ambient coolant temperature Tvw, the second rationality determination regarding the engine coolant temperature sensor 21 can be carried out in a short time, in comparison with the above-described open-valve state determination process of the example 1 of the determination process, that is, in comparison with the case where the presence of an open state of the changeover valve 10 is determined on the basis of the elapsed time following the start of electrification of the electric heater 15.

That is, in the example 1 of the determination process, in order to prevent a false determination that the changeover valve 10 has opened when the changeover valve 10 actually has not opened, the coolant mixture criterion time is adapted on the basis of the condition in which it takes the longest time before the changeover valve 10 is opened (e.g., a condition in which the engine is idling and the engine is in a low-temperature environment). However, as for such an adaptation, the margin is very large, so that there is inevitably a long time before the second rationality determination regarding the engine coolant temperature sensor 21 is performed. However, by adopting a design such that it is determined that the changeover valve 10 has opened when the estimated value of the changeover valve's ambient coolant temperature Tvw reaches the valve-opening temperature (70° C.), it becomes possible to determine that the changeover valve 10 has opened according to the actual opening of the changeover valve 10. This eliminates the need to provide the aforementioned margin, so that it becomes possible to shorten the time prior to the aforementioned rationality determination (the second rationality determination).

Incidentally, in the open-valve state determination process of this example, a reason for using an estimated value of the engine coolant temperature thw1 instead of using a detected coolant temperature value that is detected by the engine coolant temperature sensor 21 is that if the changeover valve's ambient coolant temperature Tvw is estimated from the detected engine coolant temperature value detected by the engine coolant temperature sensor 21 in a situation where there is a possibility of abnormality of the engine coolant temperature sensor 21, the reliability of the determination regarding the opening of the changeover valve 10 deteriorates.

Besides, although in the open-valve state determination process of this example, an estimated value of the changeover valve's ambient coolant temperature Tvw is calculated from the expressions (1) and (2), this is not restrictive, that is, it is also permissible to calculate an estimated value of the changeover valve's ambient coolant temperature Tvw by other techniques. For example, the following calculation technique may be employed. That is, using the engine rotation speed Ne and the load factor k1 as parameters, the coolant temperature at the coolant outlet 1*b* of the engine 1 is acquired through experiments, simulations, etc. On the basis of results of the acquisition, estimated values of the changeover valve's ambient coolant temperature Tvw are adapted and mapped beforehand by simulations or the like. Then, by referring to the map on the basis of the actual engine rotation speed Ne and the load factor k1, an estimated value of the changeover valve's ambient coolant temperature Tvw is calculated.

Although in the foregoing embodiments and examples, the heater inlet coolant temperature sensor 22 is used for the rationality determination (the second rationality determination) regarding the engine coolant temperature sensor 21, the invention is not limited so, that is, it is also permissible to use another coolant temperature sensor that detects the temperature of the coolant that passes through the heater passageway (bypass passageway) 202.

Although in the foregoing embodiments and examples, the changeover valve 10 equipped with the temperature sensitive portion that displaces the valve body is used as a control valve that controls the circulation of the coolant between the engine coolant passageway and the heater passageway (bypass passageway), the invention is not limited so, that is, it is also permissible to use a control valve that is opened and closed by a different type of actuator, for example, a solenoid or the like.

Although in the foregoing embodiments and examples, the electric coolant pump is used for the circulation of the coolant, the invention is not limited so, that is, it is also permissible to use a mechanical coolant pump for the circulation of the coolant.

Although in the foregoing embodiments and examples, the invention is applied to a cooling system in which a heater, an exhaust heat recovery device and an EGR cooler are incorporated as heat exchangers, the invention is also applicable to cooling systems in which other heat exchangers, for example, an ATF (Automatic Transmission Fluid) warmer, an ATF cooler, etc., are incorporated.

The invention can be utilized for a coolant temperature sensor abnormality determination apparatus that determines the presence or absence of abnormality of a coolant temperature sensor that detects the temperature of the coolant of an engine (internal combustion engine) that is mounted in a vehicle or the like.

The invention claimed is:

1. A coolant temperature sensor abnormality determination apparatus for use with an engine cooling system having: (i) a coolant passageway including an engine coolant passageway and a bypass passageway that bypasses an engine, (ii) a control valve configured to be in an open state to allow mixing of coolant from the engine coolant passageway and coolant from the bypass passageway at a confluence between the engine coolant passageway and the bypass passageway and configured to be in a closed state to restrict the mixing of the coolant from the engine coolant passageway and the coolant from the bypass passageway at the confluence between the engine coolant passageway and the bypass passageway, (iii) an engine coolant temperature sensor configured to detect an engine coolant temperature in the engine coolant passageway, and (iv) a bypass coolant temperature sensor arranged in the coolant passageway, downstream of the confluence between the engine coolant passageway and the bypass passageway, the coolant temperature sensor abnormality determination apparatus comprising:

an electronic control unit configured to:

open the control valve when a difference between an atmospheric temperature around the engine and the engine coolant temperature detected by the engine coolant temperature sensor at the time of starting the engine is greater than a threshold value; and determine only after the control valve is opened that the engine coolant temperature sensor is abnormal, if the difference between: (i) a temperature detected by the engine coolant temperature sensor, and (ii) a temperature detected by the bypass coolant temperature sensor, is greater than a predetermined value.

2. The coolant temperature sensor abnormality determination apparatus according to claim 1, wherein the electronic control unit determines that the bypass coolant temperature sensor is normal if the difference between the atmospheric temperature and the temperature detected by the bypass coolant temperature sensor, in the closed state of the control valve, is within a predetermined range.

3. The coolant temperature sensor abnormality determination apparatus according to claim 1, wherein:

the control valve is a temperature-sensitive operation valve that has a temperature sensitive portion configured to displace a valve body; and the electronic control unit is configured to determine that the control valve has opened when an estimated value of ambient coolant temperature of the control valve becomes equal to or greater than a valve-opening temperature of the control valve.

4. The coolant temperature sensor abnormality determination apparatus according to claim 1, wherein the electronic control unit executes the determination on whether the engine coolant temperature sensor is abnormal after a predetermined time elapses following the opening of the control valve.

5. A coolant temperature sensor abnormality determination method for use in an engine cooling system having: (i) a coolant passageway including an engine coolant passageway and a bypass passageway that bypasses an engine, (ii) a control valve configured to be in an open state to allow mixing of coolant from the engine coolant passageway and coolant from the bypass passageway at a confluence between the engine coolant passageway and the bypass passageway and configured to be in a closed state to restrict the mixing of the coolant from the engine coolant passageway and the coolant from the bypass passageway at the confluence between the engine coolant passageway and the bypass passageway, (iii) an engine coolant temperature sensor configured to detect an engine coolant temperature in the engine coolant passageway, and (iv) a bypass coolant temperature sensor arranged in the coolant passageway, downstream of the confluence between the engine coolant passageway and the bypass passageway, the coolant temperature sensor abnormality determination method comprising:

opening the control valve when a difference between an atmospheric temperature around the engine and the engine coolant temperature detected by the engine coolant temperature sensor at the time of starting the engine is greater than a threshold value; and determining only after the control valve is opened that the engine coolant temperature sensor is abnormal, if the difference between: (i) a temperatures detected by the engine coolant temperature sensor, and (ii) a temperature detected by the bypass coolant temperature sensor, is greater than a predetermined value.

6. The coolant temperature sensor abnormality determination method according to claim 5, further comprising:

determining that the bypass coolant temperature sensor is normal if the difference between the atmospheric temperature and the temperature detected by the bypass coolant temperature sensor, in the closed state of the control valve, is within a predetermined range.

7. An engine cooling system comprising:

a coolant passageway having an engine coolant passageway and a bypass passageway that bypasses an engine;

a control valve configured to be in an open state to allow mixing of coolant from the engine coolant passageway and coolant from the bypass passageway at a confluence between the engine coolant passageway and the bypass passageway and configured to be in a closed state to restrict the mixing of the coolant from the engine coolant passageway and the coolant from the bypass passageway at the confluence between the engine coolant passageway and the bypass passageway;

an engine coolant temperature sensor configured to detect an engine coolant temperature in the engine coolant passageway;

a bypass coolant temperature sensor that is arranged in the coolant passageway, downstream of the confluence between the engine coolant passageway and the bypass passageway; and an electronic control unit configured to:

open the control valve when a difference between an atmospheric temperature around the engine and the engine coolant temperature detected by the engine coolant temperature sensor at the time of starting the engine is greater than a threshold value; and determine only after the control valve is opened that the engine coolant temperature sensor is abnormal, if the difference between: (i) a temperature detected by the engine coolant temperature sensor, and (ii) a temperature detected by the bypass coolant temperature sensor, is greater than a predetermined value.

8. The coolant temperature sensor abnormality determination apparatus according to claim 1, wherein the threshold value is set at 70° C.

9. The coolant temperature sensor abnormality determination apparatus according to claim 1, wherein the predetermined value is set in a range between −20° C. to 20° C.

10. The coolant temperature sensor abnormality determination method according to claim 5, wherein the threshold value is set at 70° C.

11. The coolant temperature sensor abnormality determination method according to claim 5, wherein the predetermined value is set in a range between −20° C. to 20° C.

12. The engine cooling system according to claim 7, wherein the threshold value is set at 70° C.

13. The engine cooling system according to claim 7, wherein the predetermined value is set in a range between −20° C. to 20° C.

* * * * *